US005159764A

United States Patent [19]

Wireman et al.

[11] Patent Number: 5,159,764

[45] Date of Patent: Nov. 3, 1992

[54] APPARATUS FOR CONDITIONING PARTICULATE MATERIAL

[75] Inventors: Jack Wireman; Daniel R. Wireman, both of Fallbrook, Calif.

[73] Assignee: Blaw Knox Food and Chemical Equipment Co., Inc., Buffalo, N.Y.

[21] Appl. No.: 727,933

[22] Filed: Jul. 10, 1991

[51] Int. Cl.[5] ..... F26B 17/00

[52] U.S. Cl. ..... 34/57 E; 99/483; 34/58

[58] Field of Search ..... 34/57 E, 57 A, 57 R, 34/58, 10; 426/467, 311, 319; 99/483

[56] References Cited

U.S. PATENT DOCUMENTS 4,532,155 7/1985 Golant et al. ..... 34/57 E

*Primary Examiner*—Henry A. Bennet

*Attorney, Agent, or Firm*—Bacon & Thomas

[57] ABSTRACT

A controlled spinning bed of particulate material such as coffee beans or the like is formed and maintained in a stationay chamber, the particulate material is mixed and uniformly conditioned. For example, coffee beans are uniformly roasted within a relatively short time and cooled in a similar but separate chamber with or without an intermediate quench. A movable bean spill which is movable upwardly or downwardly into engagement with the spinning bed is provided for directing a portion of the beans out of the bed inwardly and downwardly to increase the mixing of the beans. The movable beam spill includes a compound surface defined by a two-dimensional surface.

10 Claims, 4 Drawing Sheets

FIG. 5
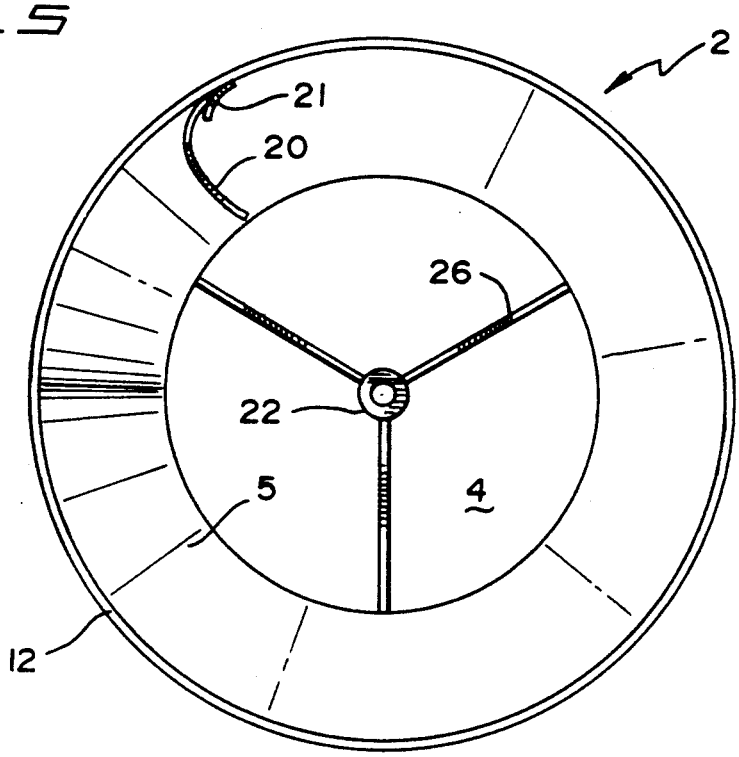
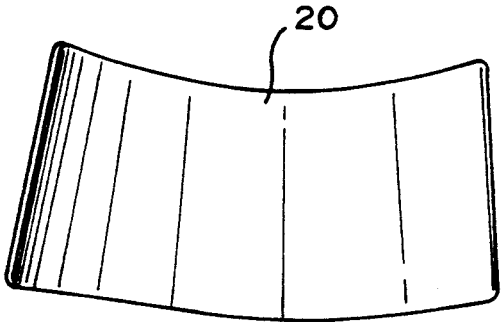
FIG. 6
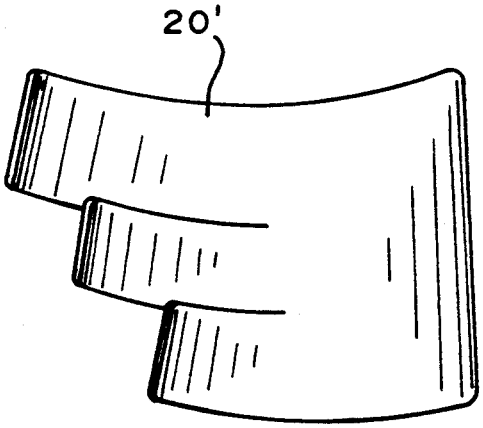
FIG. 6a

APPARATUS FOR CONDITIONING PARTICULATE MATERIAL

This invention relates to an apparatus for conditioning particulate material and more particularly to an improved apparatus for forming, heating and/or cooling a controlled spinning bed of particulate vegetable material.

BACKGROUND OF THE INVENTION

In its simplest form, coffee roasting comprises heating a single bean to a prescribed temperature at which point chemical reactions occur that transform the bean into the desired state of pyrolysis. These reactions occur in the last part of the heating cycle. Thus, the residence time at the terminal temperature is crucial because a difference in a few seconds in heat-history can have a significant effect on the taste of the coffee.

The problem is that it is difficult to design a roaster that will roast several hundred pounds of beans at one time and to roast every bean evenly. Whether the process for heat transfer is from convection, conduction, radiation, or some combination thereof, the heat is absorbed in the first few layers of a bean bed. Therefore, it is desirable to establish some means for equalizing bean temperature throughout the heating cycle so that when the final roasting temperatures are approached, all of the beans will be close to the same temperature during the pyrolysis process.

The aforementioned problems have been overcome to a large degree by the Apparatus and Process for Conditioning Particulate Material disclosed and claimed in our co-pending U.S. patent application, Ser. No. 07/463,557, which was filed on Jan. 11, 1990, and which is incorporated herein in its entirety by reference.

In essence, a preferred embodiment of that invention comprises a chamber for receiving a charge of particulate material such as a charge of coffee beans. The chamber has a generally circular base and an upwardly extending divergent wall defining a segment of a cone with a central axis and closed bottom. The divergent chamber wall preferably forms an included angle with respect to a horizontal plane of between 40° to 85° and also defines a plurality of openings in a lower portion thereof. Means are provided for inducing a mass of heated fluid generally tangentially into the chamber to rotate the coffee beans about the central axis of the chamber and for maintaining the rotating material in a relatively densely packed or controlled state during the heating thereof. During the rotation of the coffee beans, the chamber is stationary, i.e., it does not rotate about its central axis so that there is relative movement between the rotating material and the stationary chamber. In addition, there is also vertical and radial movement of the coffee beans with respect to the chamber. This embodiment also results in horizontal shearing within the spinning bed since beans near the chamber bottom are rotating around the chamber at a higher angular velocity than the beans near the chamber top.

In a preferred form of the aforementioned apparatus, a second chamber is provided and disposed below the heating chamber for receiving the roasted beans and for rapidly cooling the beans in a similar manner.

Coffee roasters in accordance with our earlier invention uniformly roast batches of coffee very rapidly with an efficient use of energy. They also provide conditioning, cooling, heating and roasting apparatus which is relatively flexible, competitively priced, relatively simple in operation, free of complexity and easy to operate and maintain. In addition, such roasters occupy a relatively small area and can be rapidly converted to operate under different conditions in a job shop type of operation while fulfilling most of the requirements for food processing.

However, it has now been found that an improved apparatus, according to the present invention, provides all of the aforementioned advantages while adding improved flexibility. For example, the apparatus according to the present invention, can accommodate a greater range in charge variations, types of roast and greater control over the uniformity and quality of the roast.

The improved apparatus, according to the present invention, will accommodate relatively small to relatively large charges of beans and provides a more gentle bean action which results in fewer broken beans. The apparatus can also be programmed to maintain an optimal bean circulation during the roasting operation to compensate for the green to roasted bean expansion of almost 2:1. The apparatus also includes an improved bean spill which retains most of the coffee bean's tangential velocities while directing them to the bottom of the chamber. This reduces the likelihood of bean carryover caused by slow moving beans in close proximity to the central updraft of the air leaving the bean bed and exiting the top of the chamber and is thought to be relatively easy to fabricate. The present design may also more readily accommodate a "well"-type temperature measurement which can be used to improve temperature control during the roasting operation.

SUMMARY OF THE INVENTION

In essence, the present invention contemplates an apparatus for conditioning particulate material which includes a chamber for receiving a charge of particulate material, such as coffee beans. The apparatus also includes means for forming a controlled spinning bed of material within the chambers and with relative motion between the spinning bed and the chamber. Means are also provided for subjecting the controlled spinning bed of material to a conditioning step such as heating, drying, roasting and/or cooling. An important feature of the present invention resides in a movable bean spill or separating means for directing a portion of the particulate material out of the spinning bed from a first location within the bed, such as the top of the bed, toward a second location, such as the bottom of the bed. In the apparatus according to the present invention, means are provided for moving or positioning the movable bean spill from the exterior of the chamber.

BRIEF DESCRIPTION OF THE DRAWINGS

The invention will now be described in connection with the accompanying drawings, in which:

FIG. 5 is a top plan view of a chamber illustrating a channel or track for a bean spill;

FIG. 6 is a perspective view of a bean deflector or spill including a compound curve which is defined by a twisted two-dimensional surface; and FIG. 6a is a perspective view of a bean deflector or spill including multiple-curved surfaces.

DETAILED DESCRIPTION OF THE PREFERRED EMBODIMENTS OF THE INVENTION

Figure 1:
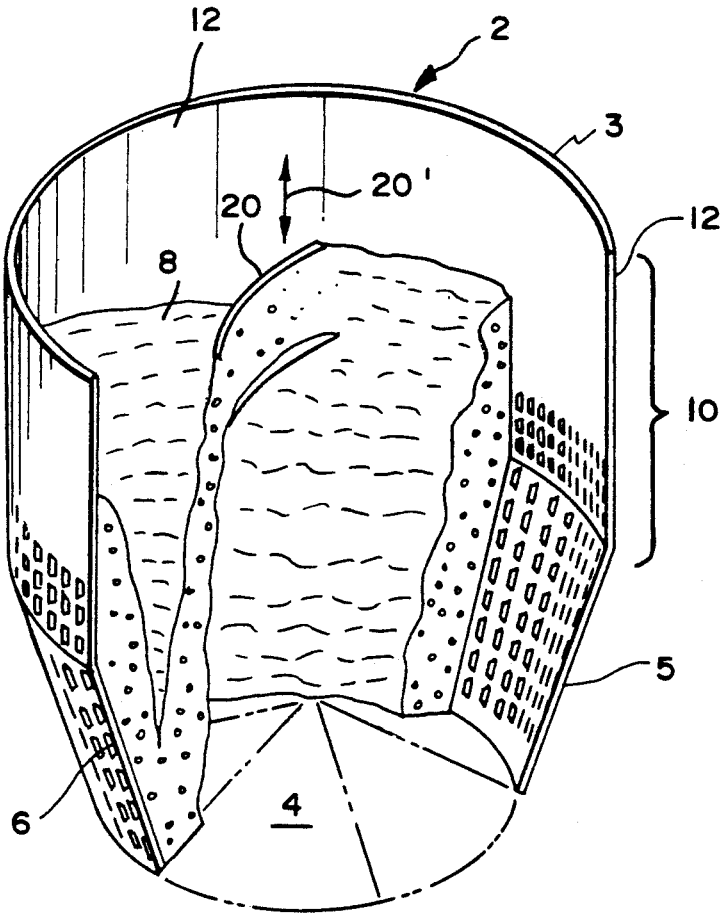
FIG. 1 is a partially broken away perspective view of a chamber having a controlled spinning bed of particulate material therein.

In considering convection heat transfer to particles in a bed, heat transfer texts show that the best heat transfer coefficient occurs when the porosity of the whole bed is at a minimum. This minimum porosity occurs in a packed bed, i.e., when the amount of open space between all of the particles is taken with the particles piled at rest. However, in roasting coffee beans in a fluid bed, the updrafted air lifts or levitates the beans and spouting (the equivalent of bubbling in a boiling liquid) occurs long before the proper amount of air can be circulated to produce a fast roast, i.e., a complete uniform roast within 60 to 90 seconds.

Thus, the present invention relates to an apparatus which will maintain the beans in a relatively packed bed condition during heating or roasting and, at the same time, provide good turning or mixing of the beans within the bed to obtain temperature equilibrium. In essence, the apparatus has been designed in an endeavor to raise each bean in the bed to the same temperature and to subject each bean to the same heat history.

The controlled spinning bed as defined herein is a quasi-packed bed, i.e., it approaches the porosity of a packed bed, but is constantly moving about a central and preferably vertical axis. For example, in a controlled spinning bed, the beans have an apparent weight which is equal to or greater than the lifting drag of the air passing over the beans. Thus, the controlled spinning bed provides a well-ordered movement of each of the particles therein and essentially eliminates the random movement of particles which is associated with a fluid bed. A controlled spinning bed also causes the particles in the outer portion of the bed to move upwardly in a spiral direction while those in the upper portion of the bed are directed and/or moved downwardly to the bottom of the bed.

In addition, a controlled spinning bed provides a centrifugal force component which is several times that of gravity. This apparent weight increase improves the heat transfer process by allowing the passage of a relatively large amount of air at a relatively high velocity to pass through the bed without causing apparent weightlessness and its attendant spouting or fluidization. Thus, the controlled spinning bed differs from the more common fluidized bed wherein individual particles are lifted upwardly by the fluid flow and are subjected to a period of apparent weightlessness.

This elimination of spouting and/or fluidization is desired since the best heat transfer occurs when the porosity of the whole bed is at a minimum, i.e., when the amount of open space between the beans is approximately the same as when the beans are piled at rest. However, it should be recognized that some minimal spouting that is over perhaps about 5% of the surface may occur.

Thus, the controlled spinning bed differs from the conventional fluidized bed wherein individual particles are lifted upwardly by the fluid flow drag and are subjected to a period of apparent weightlessness. The spinning controlled bed also differs from a conventional packed bed since the controlled spinning bed provides relative movement between the particles which transfer heat throughout the bed and allows a much greater velocity of air to pass through the bed without levitating the particles. This desirable movement between particles is further enhanced by the improved movable bean spill which is defined hereinafter.

In a controlled spinning bed in accordance with the present invention there is also relative movement between the bed and the chamber along a plurality of axes. For example, the spinning bed moves rotationally around the central axis of a stationary chamber while beans within the bed move upwardly and after encountering a bean spill (to be described hereinafter), downwardly. It is also apparent that there is some radial movement of the beans, i.e., outwardly from the inner surface of the bed toward the wall while other beans that have slowed down move inwardly in a more or less radial direction.

In roasting coffee, it is desirable to transfer a certain amount of heat into the beans in a given amount of time. And, when it is desired to roast coffee in a very short period of time, there are essentially two alternatives. First, the temperature can be increased. However, increasing the temperature above a given level will burn the surface of the bean and at times cause a fire and/or explosion. The second alternative, which is utilized in the present invention, is to increase the velocity of hot air across the bean without driving the bean out of the bed. Thus, the film coefficient is higher than in a fluidized bed and the relative movement of the particles in the controlled spinning bed improves the heat distribution throughout the bed by mass transfer.

It is also believed that the use of a lower temperature, e.g., an air temperature of between about 550°-650° F. (287°-343° C.) across the beans, provides better control of the roasting process, results in energy savings, a safer operation and with a substantial reduction in the risk of fire.

A coffee roaster, according to a first embodiment of the invention, will now be described in connection with the accompanying drawings wherein like reference numerals have been used to designate like parts.

A coffee roaster 2 comprises a generally upright chamber 3 (FIGS. 1 and 2) which is adapted to receive a charge of coffee beans. The chamber 3 has a generally circular base 4 and an upwardly extending divergent wall 5 which defines a segment of a cone with a central axis (not shown). The circular base 4 may as illustrated define a relatively shallow cone which extends upwardly into the chamber so that any coffee beans falling thereon will flow outwardly toward the upwardly extending wall 5 of chamber 3.

A lower portion of chamber 3 also defines a plurality of openings 6 or preferably louvers which are adapted to receive a mass of air. For example, heated air is induced tangentially into the chamber 3 through the opening 6 to form and maintain a spinning controlled bed of beans 8 as illustrated in FIG. 1.

The chamber 3 also includes an upper portion 10 which is coaxial with the lower portion and which includes an upwardly extending wall 12. This upwardly extending wall 12 may define a right circular cylinder, a conical section wherein the slope of wall 12 is greater than the slope of wall 5. In some cases, it may be possible to substitute a relatively flat lid with a central opening or in other cases to eliminate the upper portion 10. In the latter case, the conical segment of the lower portion would be extended to a greater height and the upper portion thereof would be free of openings or louvers.

The purpose of the upper portion 10 is to stop the upward climb of the beans along the wall 5. The beans in the bed will preferably move spirally upwardly along the wall 5 because of the centrifugal force component on the bed. For example, the forces working on a single bean in the bed 8 is rotated about the central axis of the chamber 3 by means of tangentially induced air and is subjected to a centrifugal force component which forces the bean outwardly toward the wall 5. The weight of the bean produces a vertical component. Thus, there is a resultant force, which is due to the gravity and centrifugal acceleration. This resultant force should be approximately normal to the wall 5 or have a slight upward component which will force the bean within the spinning bed to climb upwardly along a spiral path along wall 5. Thus, the forces acting on the beans in bed 8 cause the beans to climb the cone-shaped chamber and form a free surface which is approximately parallel to the wall 5.

Thus, the purpose of the air is two-fold. First, the air imparts sufficient velocity to the beans to maintain the spinning bed; and, second provides heat transfer to the beans. In practice, the air spins the beans about the central axis fast enough so that the centrifugal force component is several times that of gravity. This apparent weight increase is important for heat transfer and permits a substantial amount of air to pass through the bed without levitating the beans. In fact, the result is a relatively stable spinning bed in which the beans follow a relatively defined path, remain in a relatively dense bed with a flow of gas through the bed and with controlled mixing which provides a uniform roast so that each of the beans in the bed experience essentially the same heat history.

The high velocity heated air enters the chamber 3 generally tangentially through the opening 6, past louver and passes through the bed 8. For example, air which is preheated to 550° to 650° F. (287° to 343° C.) enters the chamber 3 through opening 6 at, for example, approximately 100 to 125 feet per second while the beans are travelling at approximately 10 feet (3.05 meters) per second. As a result, there is a high relative scrubbing in the layer of beans next to the chamber and a very high film coefficient of heat transfer. Also, as the air transfers its momentum to the beans, it slows and follows a generally curved path through the bed and exits in a direction which is approximately normal to the inner surface of the bed 8. At that point, its velocity has decreased to about 10 feet (3.05 meters) per second which is insufficient to uplift or levitate the beans. Suitable means such as a plurality of nozzles (not shown) direct the air toward the louvers or openings 6 so that the air enters the chamber in a mostly tangential direction.

Once established, the bed will remain in essentially dynamic equilibrium with a minimal amount of recirculation as the beans in the outer portion of the bed spiral upwardly and those on the inner portion spiral downwardly. Thus, a stable spinning bed as described above can be established and maintained by selecting the slope of the chamber wall, diameter of the chamber and air velocity. For example, with a larger load of coffee beans, the beans in the inner free surface will be subjected to the effects of gravity more so than those at the outer edge of the bed, i.e., closest to the chamber wall.

To accommodate different loads and obtain uniform roasting during a relatively short roasting cycle, it is desirable to increase the mixing of the beans within the bed. For this reason, it is desirable to add separate mixing means to mechanically turn and mix the bed. FIG. 5 illustrates a moveable mechanical mixing means or bean spill 20 which is partially broken away to illustrate the movement of the beans within bed 8. The bean spill 20, according to a presently preferred embodiment of the invention, is illustrated in FIG. 6 and is formed of a curved metallic plate which curves downwardly and inwardly as illustrated and which is movable vertically with respect to wall 12. The movable spill 20 is an important feature of the present invention and is constructed and arranged for vertical movement to accommodate various quantities of material. This vertical movement is illustrated by arrow 20' in FIG. 1.

The spill 20 is movably mounted at a level where it will intersect and extend down into the upper portion of the spinning bed 8. Thus, the spill 20 interrupts the top layer of beans in an outer portion of bed 8 (see FIG. 1) and directs the stream away from the wall 5 and back to the bottom of the bed. The movable spill 20, in accordance with a preferred embodiment of the invention, has a compound curved shape defined by a twisted two-dimensional surface as shown in FIG. 6. For ease of fabrication, the compound curved shape is made of a single sheet of metal; however, it is readily apparent that the twisted surface of the preferred embodiment could be readily constructed from more than one sheet of suitable material without departing from the scope of the claims. And, in accordance with one preferred embodiment of the invention, the spill 20 is constructed and arranged so that the recirculation rate is large enough to totally turn over the bed in a matter of several seconds for good temperature equilibrium. A further embodiment of the invention also contemplates a bean spill 20 with multiple surfaces, i.e., with a different curvature in various parts of the spill (not shown).

The movable spill 20 causes the beans to be recirculated in a controlled manner wherein the beans follow a prescribed path. This movable spill 20 moves vertically along track 21 (shown in FIG. 2) and is particularly useful in batch type of operations when it is frequently desired to produce various amounts and/or blends of coffee. In such operations, a coffee processor may mix different type of beans such as Columbian and Brazilian to obtain a particular flavor. However, by using the apparatus disclosed and claimed herein, each type of bean can be added to the roaster or hopper without premixing and the spinning controlled bed, in cooperation with the movable bean spill, will produce a uniform blend of uniformly roasted coffee with minimal bean breakage.

The movable spill 20 which is described and claimed herein is designed to accommodate various charges or weights of beans and to obtain optimum mixing of the beans without breaking the beans. For example, as coffee beans are roasted, they expand to thereby increase the volume of the bed. For this reason, it may be desirable to provide programming means, not shown, to raise the bean spill during the roasting process and thus maintain an optimal turnover of the beans.

Figure 2:
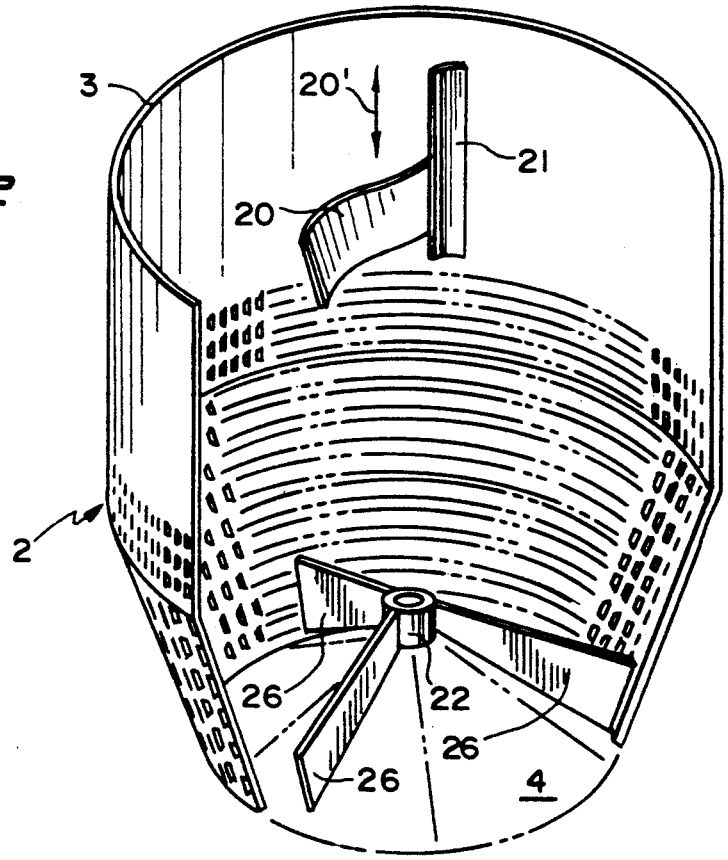
FIG. 2 is a partially broken away perspective view of the chamber, shown in FIG. 1 with a movable bean spill and mechanical means for assisting in the rotation of a centrifugally-packed bed, but without particulate material therein.

This mechanism, illustrated in FIG. 2, is applicable for coffee processors who need added flexibility in processing different loads. For example, such processors may be called upon to roast relatively light to relatively heavy loads of coffee. Therefore, to accommodate a relatively wide range of loading, a mechanical mixing or stirring device 22 has been added to chamber 3. The mixing device 22 comprises a central rotatable hub 24 and a plurality of paddles 26. The paddles are constructed and arranged to fit relatively closely to the wall 5 and conical base 4 and to rotate about the central axis of chamber 3. These paddles mechanically push the recirculated beans back into the bed at loadings other than optimum. The paddles 26 also help to start the whole bed 8 spinning at the beginning of a roasting operation.

The operation of the apparatus according to the presently preferred embodiments of the invention will be described in more detail in connection with FIG. 3. For example, approximately 50 pounds (22.7 kilos) of green coffee beans are loaded into a cylindrical hopper 30. This hopper 30 may be approximately 16 inches (40.64 cm) in diameter with a height of about 12 inches (30.48 cm) and includes a conical-shaped lower portion 31 which would, if extended to an apex form an angle of about 90°. It is also desirable to have a closable opening at the bottom of about 5.5 inches (13.97 cm) so that the 50 pounds (22.7 kilos) of beans can be dumped into the roasting chamber 3 within about 3 seconds. In essence, it is desirable to charge the roaster as fast as possible to minimize dead time in between roasting. A roaster as described would, for example, have a capacity of about 700 to 1,000 pounds (317.5 to 453.6 kilos) of coffee per hour.

Figure 3:
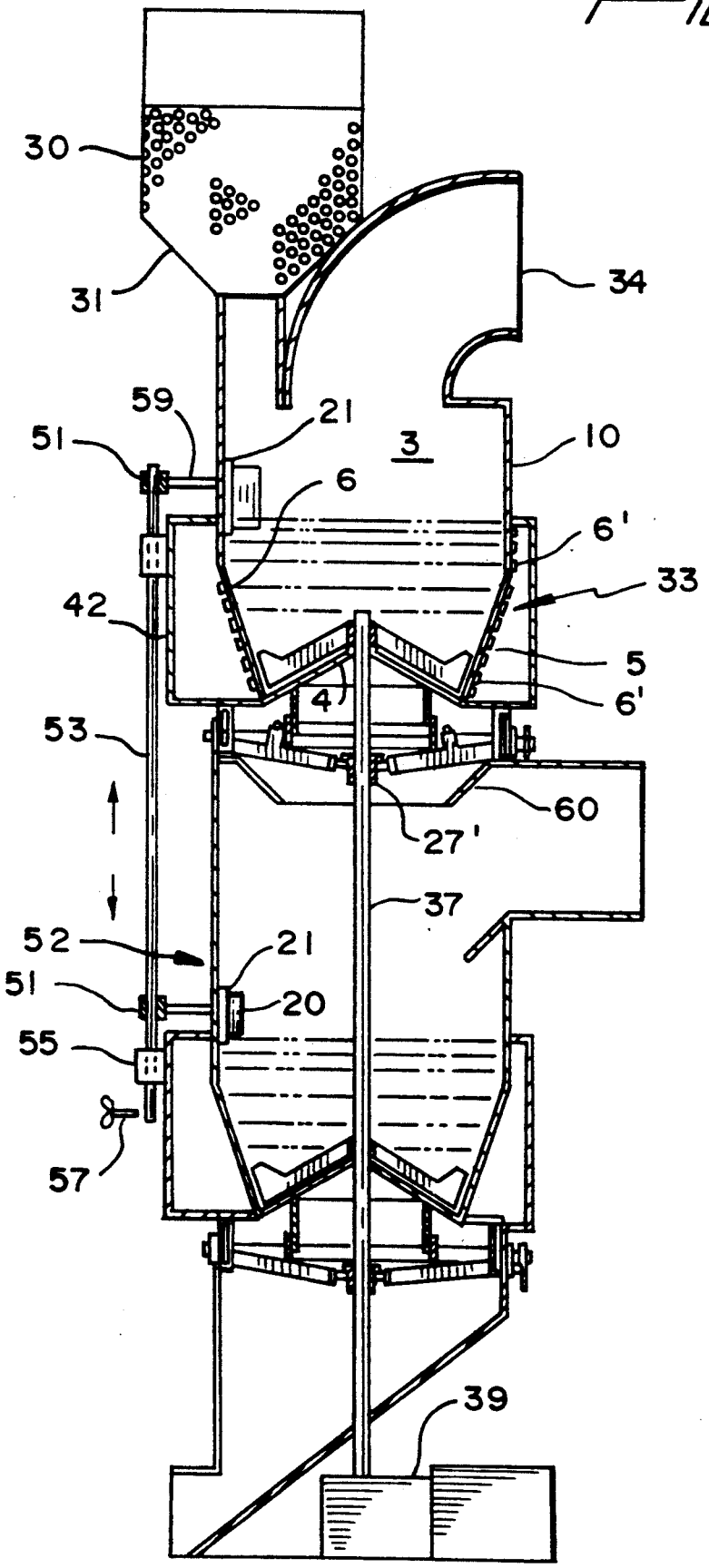
FIG. 3 is a cross-sectional view of a coffee roaster according to the present invention which shows the mixing means schematically.

As illustrated in FIG. 3, the roasting chamber 3 includes a lower section 33 which contains a plurality of louvers 6' and a cylindrical upper section 10 which is the same diameter as a cylindrical portion of lower section 33. This cylindrical upper section 10 may also include a plurality of openings 6 and louvers 6' in a lower portion thereof and may include a viewing port (not shown). The chamber 3 also includes an opening or vent 34 for exhausting air and the normal chaff produced during the roasting of the coffee.

The lower section 32 and chamber 3 are surrounded by an inlet scroll or manifold 42 which directs the air in a direction which is generally or mostly tangentially toward the louvers in the lower section. The paddles 26 are rotated in the direction of the louvers by means of shaft 37 and motor drive assembly 39 to aid in the initial rotation of the beans, and heated air at a temperature between 550°–650° F. is pumped into the manifold 42 and is directed toward the louvers 6' and into the interior of chamber 3 to form and maintain a stable controlled spinning bed of beans.

The manifold 42 may also be connected to a centrifugal blower or spiral impeller (not shown) and is constructed and arranged to direct a flow of heated air through the louvers 6' in the lower section in a mostly tangential direction to spin the coffee beans about a central and vertical axis. This tangentially directed air enters the chamber through, for example, 10 rows of 1 inch louvers with ¾ inch (1.9 cm) spacings and which are disposed with an upward angle of about 22°. It is presently believed that the upward angle aids in supporting the spinning bed without levitating the beans. The inlet scroll or spiral distributor is, in essence, the reverse of a spiral diffuser and is constructed and arranged so that the air is directed toward the louvers in a tangential direction and in a manner such that the inlet velocity is the same or approximately the same for each louver.

The lower section and chamber 3 in an upper part thereof, or in a lower part of upper portion 10 may also include 3 circumferential rows of louvers of about 0.67 inches equally spaced and angled downwardly at about 0°, 7° and 15°, respectively, from bottom to top. These rows of louvers are shown as disposed in a right circular cylindrical section and are thought to aid in limiting the amount of climb by the beans up the wall 5 of the chamber 3.

After roasting the beans for about 60–90 seconds, the conically-shaped base 4 is moved upwardly or downwardly in a manner which will be described in more detail hereinafter and the airflow into the chamber may be stopped.

The beans passing out of the roasting chamber 3 pass downwardly through a quench ring (not shown) and are preferably sprayed with cooling water to reduce their temperature, prevent further pyrolysis and increase the humidity within the coffee beans. The partially cooled beans then drop into a second chamber 52 which is disposed coaxially or offset with and below chamber 3. Alternatively, the cooling water may be sprayed on the beans while still in the roast chamber immediately before discharge by base 4.

After the roasted coffee beans are discharged by base 4, they drop into a second chamber 52 which is similar in construction to chamber 3. Chamber 52, may be equally dimensioned and is generally similar to chamber 3. However, chamber 52 is a cooling chamber which uses air at ambient temperature for cooling the beans. Thus, the dumping means for the second chamber 52 is also generally similar to that used for chamber 3, but does not usually but may incorporate a quenching spray for further cooling or moisture adjustment of the beans.

Movable bean spills 20 are provided in chambers 3 and 52 as shown schematically in FIG. 3. The spills 20 are coupled by a single shaft 53 which moves upwardly and downwardly in response to an adjusting mechanism 57 which is disposed on the outside of the chamber. The movable spills 20 which move upwardly and downwardly with shaft 53 and coupled to shaft 53 by means of members 59 which are connected shaft 53 by sleeves 51. Alternatively, a movable spill 20 may only be provided in chamber 3 since cooling is not as critical as roasting.

Figure 4:
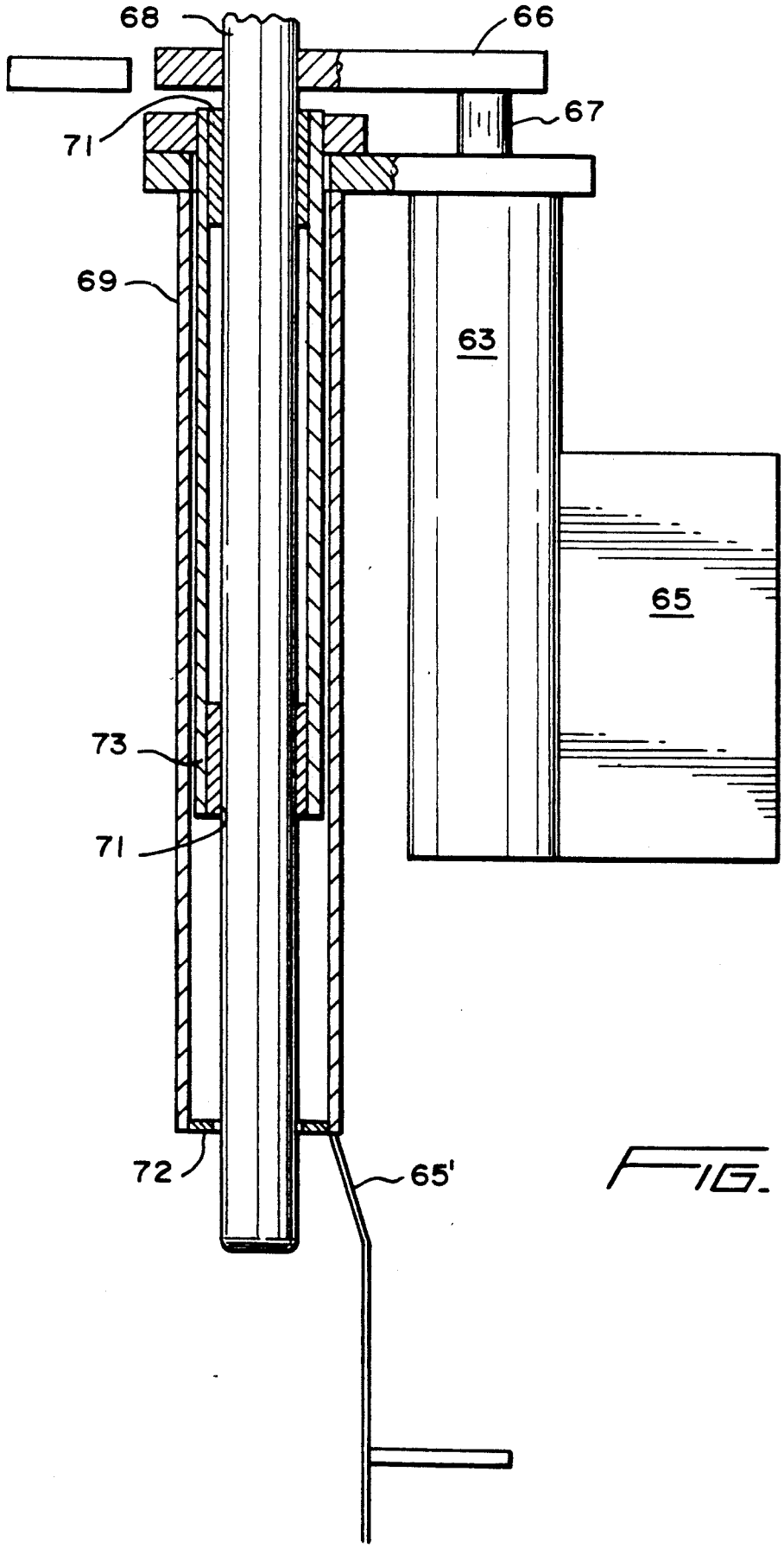
FIG. 4 is a cross-sectional view of a movable separating means according to the present invention.

A mechanism for raising and lowering bean spill 20 is shown in more detail in FIG. 4. As shown therein an activator 63 and motor 65 are fixed to an outside wall 65' of chamber 3. The mechanism includes a lifting arm 66 which is raised or lowered by means of shaft 67 by means of the activator 63. The lifting arm 66 may extend over the top of chamber 3 as illustrated or extend through an elongated opening in an upper chamber portion of chamber 3, i.e., a portion above an area which would be encountered by a spinning bed. A second vertically disposed shaft 68 extends downwardly through a mounting tube 69 which is disposed on the inside of chamber 3 in an upper portion thereof bushings 71 and bushing housing 73 are disposed in housing 69 and provide for smooth up and down movement of shaft 68. An orifice-type plate 72 at the bottom of housing 69 should have relatively close tolerance to keep chaff out of the assembly. The bean spill 20 (not shown in FIG. 4) is attached, for example, at attachment point 75 on shaft 68.

It is presently believed desirable to provide a track or lip 21 which is slidably engaged by one side of bean spill 20 as illustrated in FIG. 5. By using a compound curved bean spill 20 which slidable engages lip 21, bean breakage may be minimized and the likelihood of beans hanging up between the spill 20 and chamber 3 or 52 should be reduced.

It is also believed desirable to incorporate a bean spill with a compound curve as illustrated in FIG. 6. An alternative form of bean spill 20' is shown in FIG. 6*a*. As illustrated therein, the bean spill 20 comprises a single sheet of metal which has been formed to define a shape having a slight twist therein.

In considering the mechanism for opening or closing the chamber and for removing the beans from the chamber, it should be recognized that there will be numerous approaches which will be apparent to those skilled in the art. One such approach is directed in our aforementioned co-pending application. It should also be recognized that any means for removing the particulate material is within the scope of the appended claims and that the specific mechanism disclosed herein is not an essential part of the invention.

In designing an apparatus according to the present invention, there are a number of parameters to be considered which have been described in detail in our earlier application.

While the invention has been described in connection with several preferred embodiments, it should be understood that numerous modifications and changes may be made without departing from the scope of the appended claims.

What is claimed is:

1. In an apparatus for conditioning particulate material comprising a stationary chamber for receiving a charge of particulate material, said stationary chamber having a wall with a generally circular cross-section and a generally upright axis and first and second locations therein, means for forming a controlled spinning quasi-packed bed of the material with an upper and a lower portion within said chamber and with relative movement with respect to said chamber, means for subjecting the controlled spinning bed to a conditioning step, and means for removing the conditioning material from said chamber, the improvement comprising movable mechanical separating means intersecting the upper portion of the controlled spinning bed for directing a portion of the particulate material from the upper portion of the spinning bed out of the spinning bed and in a direction away from said wall and means for positioning said mechanical separating means with respect to the spinning bed from the exterior of said chamber.

2. Apparatus for conditioning particulate material according to claim 1 in which said movable separating means comprises a compound curved surface defined by a twisted two-dimensional surface.

3. Apparatus for conditioning particulate material according to claim 1 in which said movable separating means include multiple curved surfaces.

4. Apparatus for conditioning particulate material according to claim 1 in which said movable separating means is constructed and arranged for movement along a vertical axis.

5. Apparatus for conditioning particulate material according to claim 1 in which said movable separating means comprises a compound curved surface defined by a twisted two-dimensional sheet which is movable vertically with respect to said chamber and in which lip means extend outwardly from said wall of said chamber to form a vertical track and in which said movable separating means include one edge adjacent to and abutting said lip means so that a relatively smooth transition is provided for the particulate material from the spinning bed to the separating means.

6. Apparatus for roasting coffee comprising a stationary chamber for receiving coffee beans, said chamber having a generally circular base and an upwardly extending divergent wall defining a segment of a cone with a central axis and a plurality of openings in said wall, means for heating a fluid mass, means for inducing the heated fluid mass generally tangentially into said chamber to rotate the coffee beans about the axis with relative movement with respect to said chamber and for maintaining the rotating coffee beans in a relatively densely packed state with upper and lower portions during the heating thereof, and movable separating means for directing the coffee beans in the upper portion of the packed bed inwardly toward the central axis and out of the packed bed and toward the lower portion of the packed bed, exit means in an upper portion of said chamber for allowing the heated fluid mass and any chaff produced thereby to leave the chamber and means for removing the coffee beans from said chamber.

7. Apparatus for roasting coffee according to claim 6 in which said movable separating means comprises a compound curved surface defined by a twisted two-dimensional sheet which is movable vertically with respect to said chamber.

8. In an apparatus for roasting a mass of particulate material including a first generally vertically disposed chamber for receiving a charge of particulate material, means for forming a centrifugally packed bed of the material within said chamber, means for heating the centrifugally packed bed of material to a roasting temperature, a second generally vertically disposed chamber having an outer wall and a central axis and means for transferring the roasted particulate material to said second chamber, means for forming a centrifugally packed bed of roasted material within said second chamber, means for cooling said centrifugally packed bed of roasted material and means for removing the cooled material from said second chamber, the improvement comprising movable separating means in each of said chambers for directing a portion of the particulate material inwardly towards the central axis and downwardly.

9. In an apparatus for roasting a mass of particulate material in accordance with claim 8, the improvement further comprising movable separating means comprising a complex curved surface defined by a twisted two-dimensional surface.

10. In an apparatus for roasting a mass of particulate material in accordance with claim 9, the improvement further comprising track means including an outwardly extending lip in said wall of each of said chambers and in which each of said movable separating means include one edge adjacent to and abutting said lip means to form a relatively smooth transition from said wall to said separating means.

* * * * *